US008720753B2

(12) United States Patent
Beneš

(10) Patent No.: US 8,720,753 B2
(45) Date of Patent: May 13, 2014

(54) HANDGUN HOLSTER

(76) Inventor: Miroslav Beneš, Hradec Králové (CZ)

( * ) Notice: Subject to any disclaimer, the term of this patent is extended or adjusted under 35 U.S.C. 154(b) by 307 days.

(21) Appl. No.: 12/686,451

(22) Filed: Jan. 13, 2010

(65) Prior Publication Data

US 2011/0168748 A1 Jul. 14, 2011

(30) Foreign Application Priority Data

Jan. 15, 2009 (CZ) ..... PV 2009-14

(51) Int. Cl.
*F41C 33/00* (2006.01)
*F41C 33/02* (2006.01)

(52) U.S. Cl.
USPC ..... 224/244; 224/192; 224/193; 224/198; 224/238; 224/243; 224/911; 224/912

(58) Field of Classification Search
USPC ..... 224/244, 192, 193, 198, 238, 243, 911, 224/912
See application file for complete search history.

(56) References Cited

U.S. PATENT DOCUMENTS

| | | | | |
|---|---|---|---|---|
| 468,556 A | | 2/1892 | Anderson | |
| 1,113,530 A | * | 10/1914 | Audley | 224/244 |
| 1,641,439 A | | 9/1927 | Jovino | |
| 1,851,352 A | | 5/1930 | Denkert | |
| 1,951,865 A | | 10/1931 | Franz | |
| 2,551,913 A | | 5/1951 | Toby | |
| 3,630,420 A | | 12/1971 | Bianchi | |
| 4,101,060 A | | 7/1978 | Bianchi et al. | |
| 4,277,007 A | * | 7/1981 | Bianchi et al. | 224/193 |
| 4,694,980 A | | 9/1987 | Rogers | |

(Continued)

FOREIGN PATENT DOCUMENTS

| | | | | |
|---|---|---|---|---|
| CZ | 17500 U1 | | 4/2007 | |
| CZ | EP1975542 | * | 1/2008 | F41C 33/02 |

OTHER PUBLICATIONS

Extended European Search Report received for EP Patent Application No. 08004700.4, mailed on Mar. 31, 2010, 5 pages.

(Continued)

*Primary Examiner* — Brian D Nash
*Assistant Examiner* — Derek Battisti
(74) *Attorney, Agent, or Firm* — Patent GC LLC

(57) ABSTRACT

A handgun holster has a shaped holster body with through cavity for inserting and withdrawing the gun, which is furnished with a support for attaching the holster to the user, with a trigger safety catch and with a security system against removal of the gun from the holster where, in each of the two side walls of the holster body, in the area designed for ensuring the position of the inserted gun, there is a specularly arranged recess in which a safety catch is lodged. This recess has an opening for passage of the functional part of the safety catch into the cavity of the holster in the area designed for positioning the trigger guard of the gun. The outer covering of the safety catch, in the resting position, fits against the outer peripheral surface of the recess, while the functional part of the safety catch is a flat projection whose outer perimeter is smaller than the outer perimeter of the covering of the safety catch, so that this covering bears against the shoulder formed along the inner perimeter of the recess. Each safety catch is positioned on a pin fastened into the corresponding side wall of the body of the holster.

15 Claims, 12 Drawing Sheets

(56) References Cited

U.S. PATENT DOCUMENTS

| | | | | |
|---|---|---|---|---|
| 5,018,654 | A | 5/1991 | Rogers et al. | |
| 5,509,591 | A * | 4/1996 | Carver | 224/244 |
| 5,810,221 | A | 9/1998 | Beletsky et al. | |
| 5,918,784 | A * | 7/1999 | Serpa | 224/244 |
| 5,961,013 | A | 10/1999 | Collins | |
| 6,010,045 | A | 1/2000 | Rogers et al. | |
| 6,588,639 | B2 | 7/2003 | Beletsky et al. | |
| 6,732,891 | B2 | 5/2004 | Locklear, III | |
| 6,769,582 | B1 * | 8/2004 | Beletsky et al. | 224/244 |
| 6,799,392 | B2 | 10/2004 | Milec et al. | |
| 6,854,626 | B2 | 2/2005 | Liao | |
| 7,556,181 | B2 * | 7/2009 | Spielberger | 224/244 |
| 7,584,875 | B2 | 9/2009 | Lowe et al. | |
| 7,841,497 | B1 * | 11/2010 | Gregory et al. | 224/243 |
| 7,922,050 | B2 * | 4/2011 | Beneš | 224/244 |
| 7,950,552 | B2 * | 5/2011 | Fan | 224/243 |
| 2002/0139822 | A1 * | 10/2002 | Infanti | 224/197 |
| 2004/0195282 | A1 * | 10/2004 | Beletsky et al. | 224/244 |
| 2008/0179359 | A1 | 7/2008 | Aberle et al. | |
| 2009/0179054 | A1 * | 7/2009 | Kumuchian | 224/244 |

OTHER PUBLICATIONS

Notice of Allowance received for U.S. Appl. No. 12/007,682, mailed on Dec. 13, 2010, 14 pages.

Czech Office Action dated Feb. 16, 2010 and partial English translation, 3 pages (1 page of partial English translation and 2 pages of Office Action).

* cited by examiner

HANDGUN HOLSTER

FIELD OF THE INVENTION

This invention involves an arrangement for a handgun holster, comprising external and internal safety elements to secure the gun and prevent its removal from the holster.

DESCRIPTION OF THE PRIOR ART

There has always been a need to ensure that a gun does not fall out of a handgun holster, that it does not work loose in the holster and that it could not be subject to unauthorized removal. The known standard safeguards against removal of the gun from the holster include covering flaps or restraining straps to go around the holstered gun. These safeguards are described and illustrated, for example, in U.S. Pat. Nos. 3,630,420, 4,694,980 and 5,018,654. To secure the gun against unauthorized removal or to prevent it from falling out of the holster, various mechanisms are used, generally with a spring-loaded catch which blocks the gun in its trigger guard space. Typical embodiments of these holsters are disclosed, for example, in U.S. Pat. Nos. 468,556, 1,113,530, 1,851,352, 1,951,865, 4,101,060, 4,277,007, 5,018,654, 5,810,221, 6,732,891, 6,769,582, 6,799,392, in CZ Utility Model No. 17500 etc. An object of the present invention is to provide an improved holster for revolvers and other handguns. A further object is to present a holster which will permit the user to choose one of several degrees of security for the gun in relation to any given use, and which allows the holster to be changed from the right to the left side with minimal expense, while retaining the same holster components.

SUMMARY OF THE INVENTION

A handgun holster includes a shaped holster body with a through cavity for inserting and withdrawing the gun, which can be furnished with various kinds of supports, with or without a body rest, for attaching the holster to the user, with an external and an internal trigger safety catch and with complementary elements to secure the gun against removal from the holster. In each of two opposite side walls of the holster body, in the area designed for ensuring the position of the inserted gun, there is a specularly arranged recess, in which can be lodged a safety element or safety catch, extending into the inner space of the gun, or it can be a blind recess. This recess has an opening for passage of the functional part of a safety catch into the cavity of the holster in the area designed for positioning the trigger guard of the gun. The outer covering of the safety catch, in the resting position, fits against the outer peripheral surface of the recess, where the functional part of the safety catch is a flat projection whose outer perimeter is smaller than the outer perimeter of the covering of the safety catch, so that this covering bears against the shoulder formed along the inner perimeter of the recess, whilst each safety catch is positioned on a pin fastened into the corresponding side wall of the body of the holster. The strap can be furnished with a body rest.

The safety catch, in one embodiment, is a twin-arm lever and is pushed by its functional part, under pressure from a distancing spring positioned on a pin, into the through cavity of the body of the holster and at the same time it is furnished with a stop of the opening motion of the safety catch. The control part of the safety catch can be bent out from the body of the holster. This is called a thumb safety catch. In another embodiment the whole outer surface of the safety catch fits against the outer surface of the side wall of the body of the holster. This is called an index-finger safety catch. The resistance safety catch with inner spring preferably takes the shape of an index-finger safety catch, where the lower part of the body of the safety catch, in the direction of the cavity in the body of the holster, is rounded for the taper of the trigger guard of the gun and full deflection of the safety catch during withdrawal of the gun from the holster.

In a further embodiment the functional part of the safety catch is a rounded flexible tongue, shaped so that it extends into the through cavity of the body of the holster with its free flexible end whilst against its upper end, embedded in the side wall of the body of the holster, a stop is arranged in the holster.

The side walls of the body of the holster are specularly arranged and are reinforced in the area of the recess. The side walls of the body of the holster can be furnished on their outer surface with a circular recess with cogged perimeter and with a central threaded opening for adjustable fastening of the support of the assembly in its desired modification and subsequent arrest of the chosen position, for assembly of the restraining strap or the release lever of the restraining strap, of the covering flap or of further complementary elements of the assembly.

The front wall of the body of the holster can have a guide groove for the gun sights, on the inside and running from top to bottom of said front wall, to guide and adjust the position of the gun in the holster during insertion and withdrawal. The shape of the guide groove protects the sights against impairment or damage during manipulation of the gun in the holster and at the same time increases the rigidity of the front wall of the body of the holster.

In the rear wall of the body of the holster, there can be an upwardly open slot to facilitate the insertion and withdrawal of the gun. The body of the holster can be a flat plastic molded part whose lateral sides are bent into a U-shape to create a through cavity and secured in the desired position.

This holster is an open modular system which takes advantage of all the structural elements and at the same time provides space for the use of newly designed complementary parts. With appropriate selection of the complementary components, the design permits concealed use of the holster as a belt service holster, through to an embodiment for use with the lower installed thigh supports employed by special units. The advantage of this system lies in the simplicity, precision and adaptability of the parts for various holster assemblies with varying degrees of security according to the needs of the user. It meets user requirements for an arrangement of extension and complementary holster elements in right and left assemblies, with uniform parts for these two alternative uses. The user can choose his/her own combination of safety elements according to the intended use of the holster. It offers greater possibilities for modification of the holster, not only in terms of wear (under the arm, on a belt or on a lower thigh support) but also of its rotation up to 360°. Three types of security elements can be combined in the basic embodiment, namely, the thumb safety catch, the index-finger safety catch and the resistance safety catch, depending upon the use of the holster. Use can involve recreational shooting where two resistance safety catches are used and the gun can be withdrawn from the holster without squeezing the mechanical safety catches, concealed wearing of the gun, where one or two mechanical safety catches are appropriate, to exposed wearing of the gun while on duty, where two mechanical safety catches are used, possibly with the addition of an upper restraining strap and corresponding safety lever. All the elements can be used in both right-handed and left-handed embodiments of the holster. It involves an open modular system, with use of all the structural elements of the basic assembly, which also allows space for use of the newly designed complementary parts. The resistance safety catch with interior spring works like a thumb or index-finger safety catch and uses the same pins and springs.

The modular solution makes possible, in a simple assembly, to put together holsters for concealed use, to be worn under-arm, on the belt, below the belt for service holsters, through to the embodiment of holster assemblies with the lower installed thigh supports used by special units requiring multiple security systems for the gun in the holster, with the possibility of choosing left-handed or right-handed arrangement of the safeguarding, controlling, support and complementary elements.

BRIEF DESCRIPTION OF THE DRAWINGS

This invention may be more clearly understood by reference to the drawings and by means of the following description of the examples of preferred embodiments.

DETAILED DESCRIPTION

Figure 1:
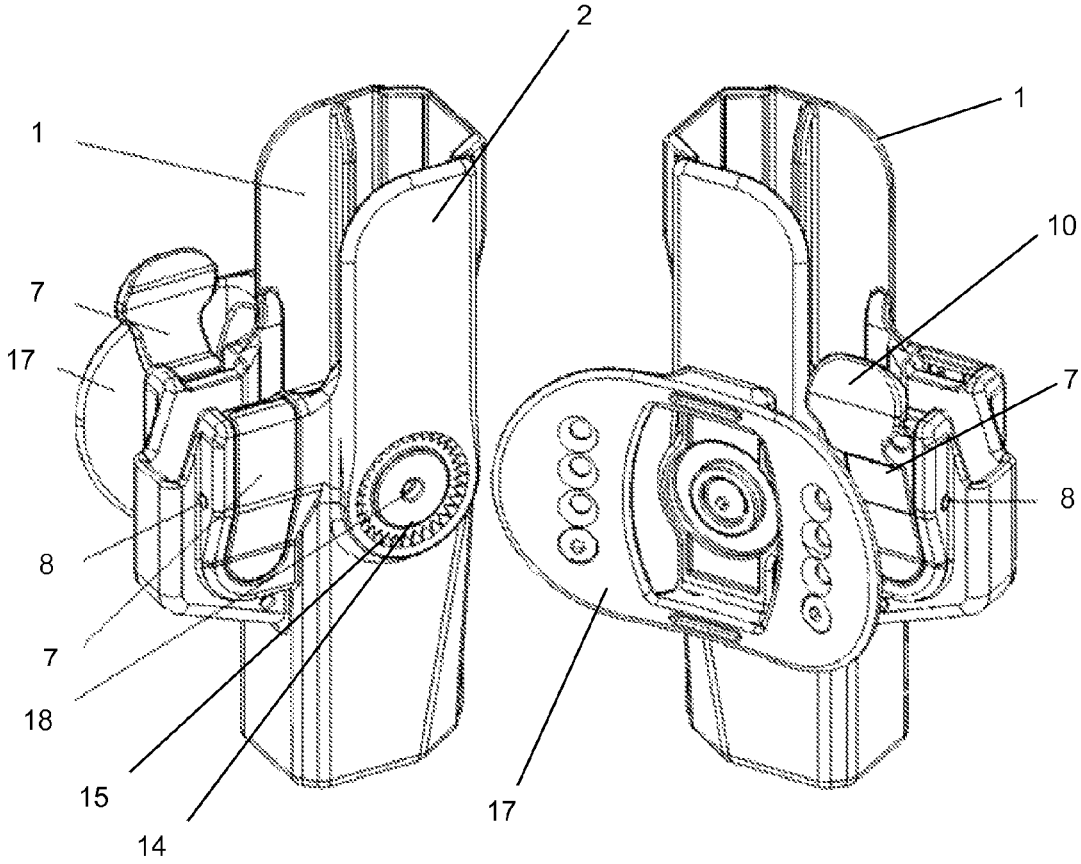
FIG. 1 is a perspective view, from two angles, of one embodiment of a holster.

FIG. 1 shows an example of an embodiment of a holster, viewed from two angles. To ensure the position of the inserted gun in the holster, the holster is furnished on one lateral side with a so-called thumb safety catch and on the opposite lateral side with a so-called index-finger safety catch, these two safety catches are lodged in recesses in the lateral sides and each individually is a twin-arm lever which is pushed by its functional part, under pressure from a distancing spring positioned on a pin, into the through cavity of the body of the holster and at the same time it is furnished with a stop of the opening motion of the safety catch.

Figure 2:
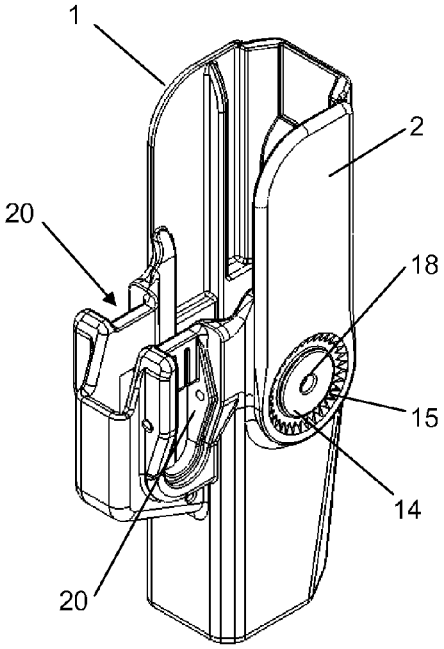
FIG. 2 is a perspective view of another embodiment of a holster.
Figure 3:
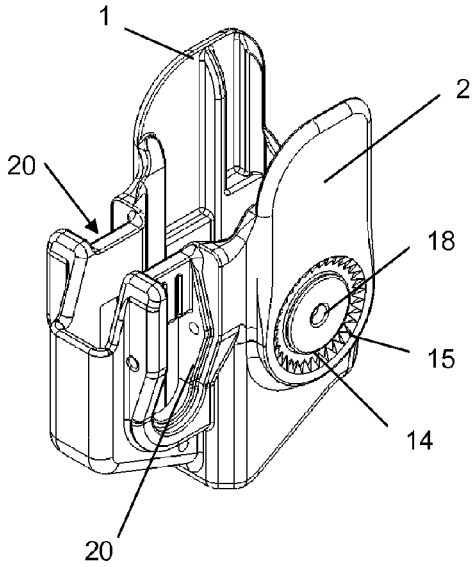
FIG. 3 is a perspective view of another embodiment of a holster.
Figure 4:
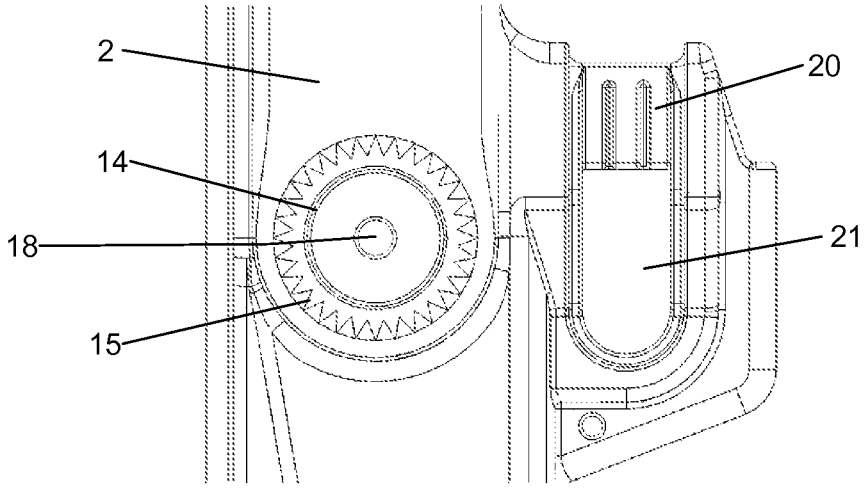
FIG. 4 is a side view of a side wall of the body of an embodiment of the holster.

FIGS. 2 and 3 illustrate two different embodiments of the holster, showing the arrangement of the recesses in the lateral sides of the holster, designed for insertion of the corresponding trigger safety catches. FIG. 4 shows details of this area of the side wall of the body of the holster where, in the adjacent part, the outer surface of the side wall is furnished with a circular recess with cogged perimeter and with a central threaded opening for adjustable fastening of the belt supports, of the end of the restraining strap or of the release lever of the restraining strap, or of the covering flap.

Figure 5:
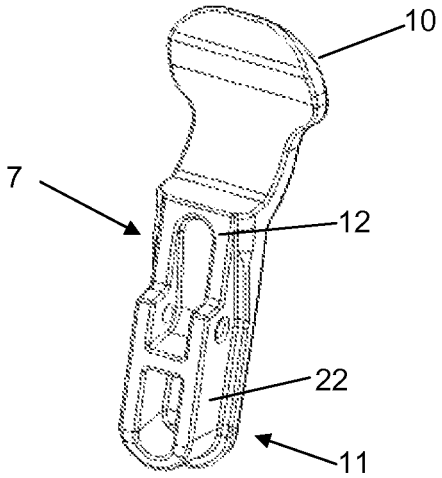
FIG. 5 is a perspective view of an embodiment of a thumb safety catch.
Figure 6:
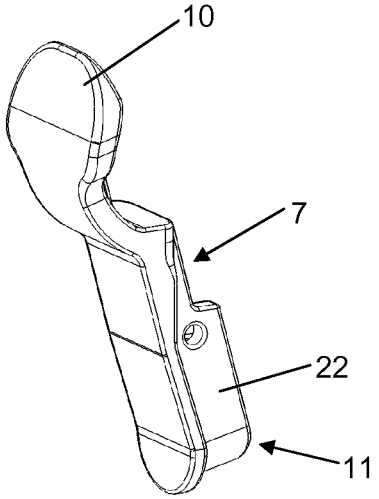
FIG. 6 is another perspective view of the embodiment of FIG. 5.
Figure 9:
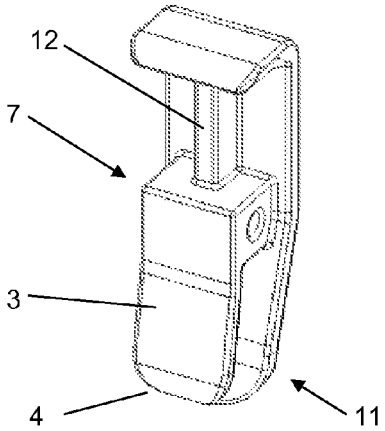
FIG. 9 is a perspective view of an embodiment of a resistance safety catch.
Figure 10:
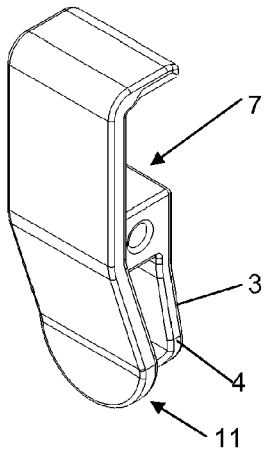
FIG. 10 is another perspective view of the embodiment of FIG. 9.

FIGS. 5 and 6 show two different views of the securing element (the safety catch) extending into the inner space of the trigger guard, which is a twin-arm lever with flat projection of its functional part, where its control part is bent outwards. This is the so-called thumb safety catch. FIGS. 7 and 8 again show two different views of the safety catch, which is a twin-arm lever with flat projection of its functional part, where the outer surface of the safety catch, after its assembly in the body of the holster, fits against the outer surface of the side wall of the body of the holster. This is the so-called index-finger safety catch. FIGS. 9 and 10 show a further possible embodiment of the safety catch, the so-called resistance safety catch. The functional part of the safety catch here is a rounded flexible tongue shaped so that, after assembly of the safety catch in the body of the holster, it extends into the through cavity of the body of the holster with its free flexible end.

Figure 7:
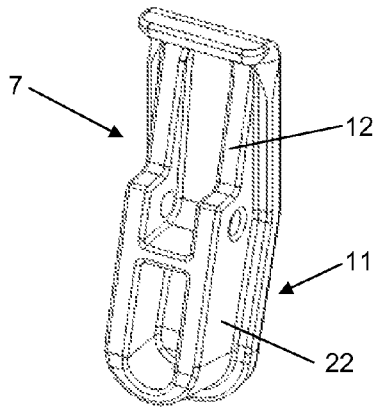
FIG. 7 is a perspective view of an embodiment of an index finger safety catch.
Figure 8:
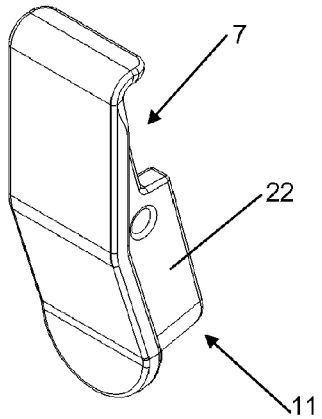
FIG. 8 is another perspective view of the embodiment of FIG. 7.
Figure 11:
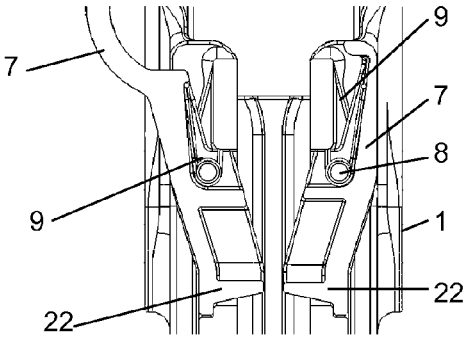
FIG. 11 is a sectional view of the security system of the gun in the holster using a thumb safety catch on one side and an index finger safety catch on the other.
Figure 12:
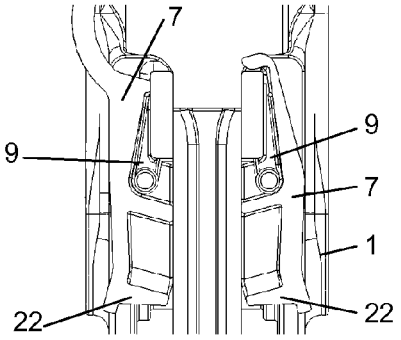
FIG. 12 is another sectional view of the security system of the gun in the holster using a thumb safety catch on one side and an index finger safety catch on the other.
Figure 13:
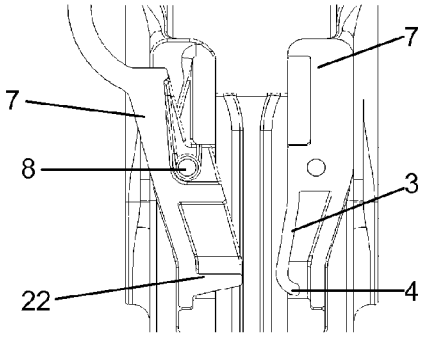
FIG. 13 is a sectional view of the security system of the gun in the holster using a thumb safety catch on one side and a resistance safety catch on the other.
Figure 14:
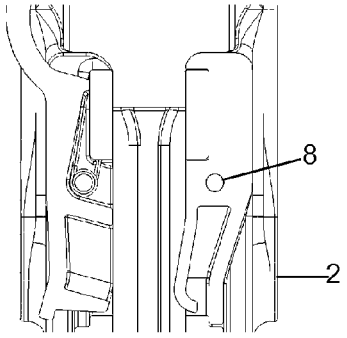
FIG. 14 is another sectional view of the security system of the gun in the holster using a thumb safety catch on one side and a resistance safety catch on the other.
Figure 15:
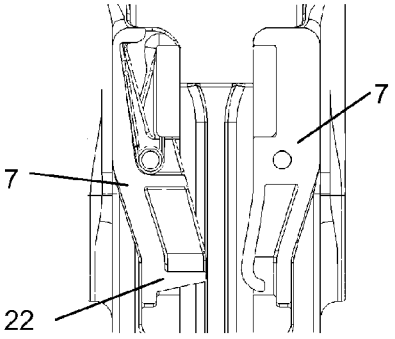
FIG. 15 is a sectional view of the security system of the gun in the holster using an index finger safety catch on one side and a resistance safety catch on the other.
Figure 16:
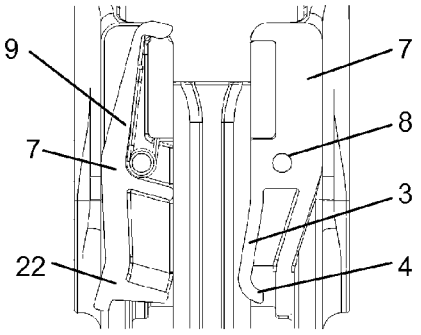
FIG. 16 is another sectional view of the security system of the gun in the holster using an index finger safety catch on one side and a resistance safety catch on the other.
Figure 17:
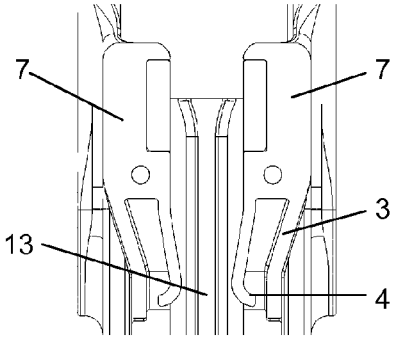
FIG. 17 is a sectional view of the security system of the gun in the holster using two resistance safety catches.

FIGS. 11 and 12 show a sectional view of the security system of the gun in the holster where, on one lateral side of the holster, a thumb safety catch is used according to FIGS. 5 and 6, whilst on the opposite lateral side of the holster there is an index-finger safety catch according to FIGS. 7 and 8. In FIG. 11 the safety catches are in the resting position and their functional parts extend into the inner cavity of the holster in the area of the trigger guard of the gun. In FIG. 12 the two safety catches are squeezed, thus freeing the inner space of the holster cavity to allow for withdrawal of the gun. FIGS. 13 and 14 likewise show the security system of the gun in the holster where, on one lateral side a thumb trigger according to FIGS. 5 and 6 is used, whilst on the opposite lateral side there is a resistance safety catch according to FIGS. 9 and 10. In FIG. 13 the thumb safety catch is in the resting position and its functional part extends into the inside cavity of the holster in the area of the trigger guard of the gun, in FIG. 14 it is squeezed, thus freeing the inner space of the holster cavity. In both these cases, the position of the resistance safety catch remains unchanged. FIGS. 15 and 16 show a similar combination of safety catches to those in FIGS. 13 and 14, but instead of the thumb safety catch, there is an index-finger safety catch. A variant is shown in FIG. 17, where along the two lateral sides of the body of the holster there are resistance safety catches according to FIGS. 9 and 10.

Figure 18:
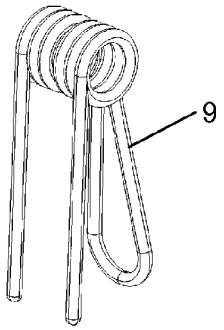
FIG. 18 is a perspective view of an embodiment of a twin-torsional distancing spring.
Figure 19:
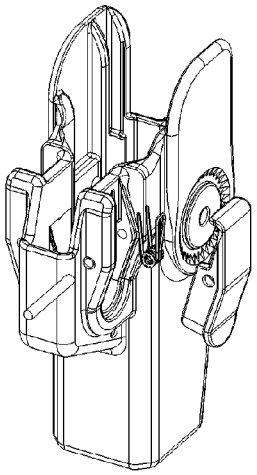
FIG. 19 is a perspective view of the holster body assembly in dismantled state with an index-finger safety catch.
Figure 20:
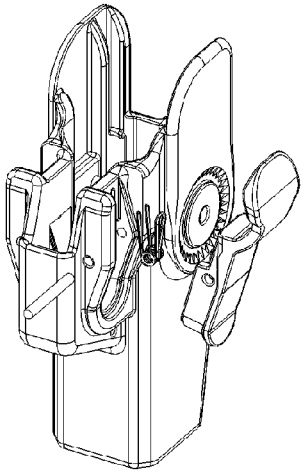
FIG. 20 is a perspective view of the holster body assembly in dismantled state with a thumb safety catch.
Figure 21:
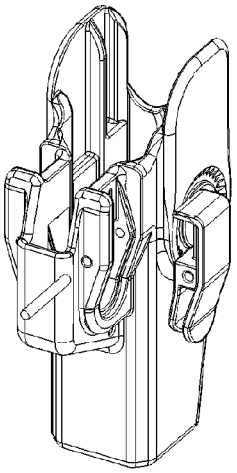
FIG. 21 is a perspective view of the holster body assembly in dismantled state with a resistance safety catch.
Figure 22:
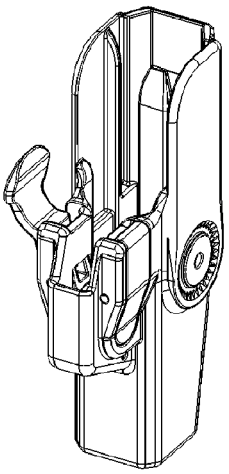
FIG. 22 is a perspective view of a holster body with mounted safety catches, on one side with thumb safety catch and on the opposite side with resistance safety catch.
Figure 23:
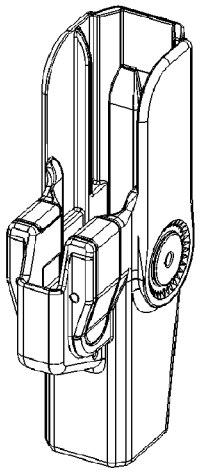
FIG. 23 is a perspective view of a holster body with mounted resistance safety catches along both sides of the body of the holster.
Figure 24:
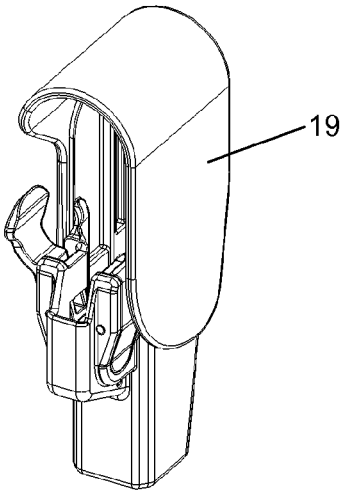
FIG. 24 is a perspective view of a holster body, as in FIG. 22, with a covering flap.
Figure 25:
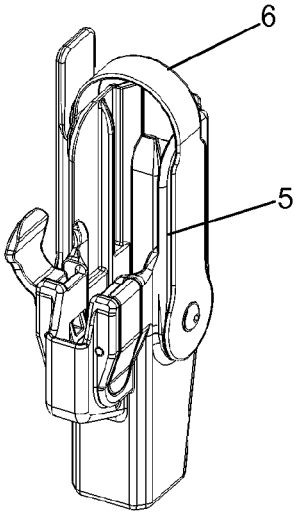
FIG. 25 is a perspective view of a holster body, as in FIG. 22, with a restraining strap.
Figure 26:
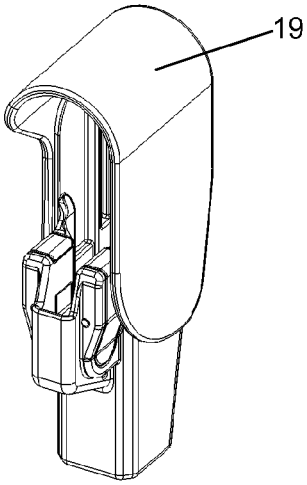
FIG. 26 is a perspective view of a holster body, as in FIG. 23, with a covering flap.
Figure 27:
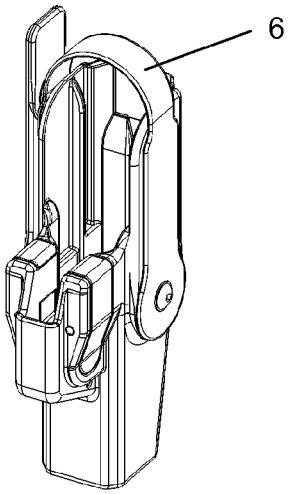
FIG. 27 is a perspective view of a holster body, as in FIG. 23, with a restraining strap.
Figure 28:
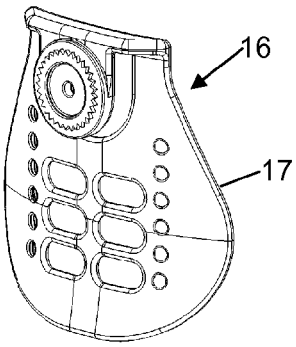
FIGS. 28 to 31 are perspective views of various embodiments of a holster support with body rests.
Figure 29:
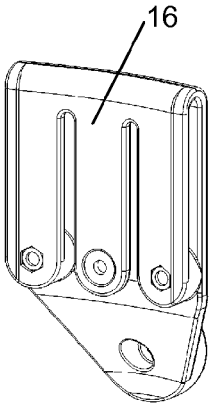
Figure 30:
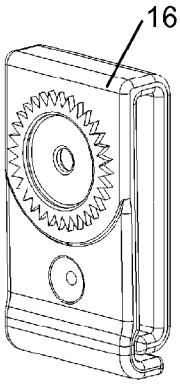
Figure 31:
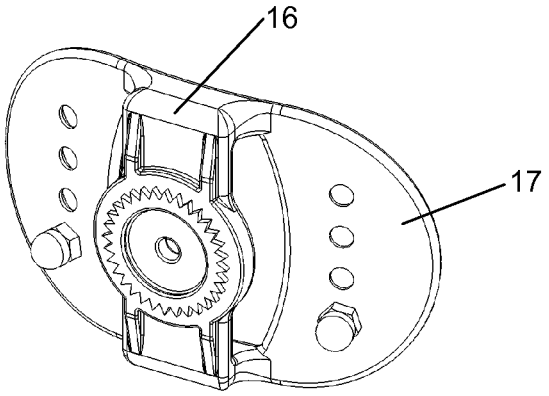
Figure 32:
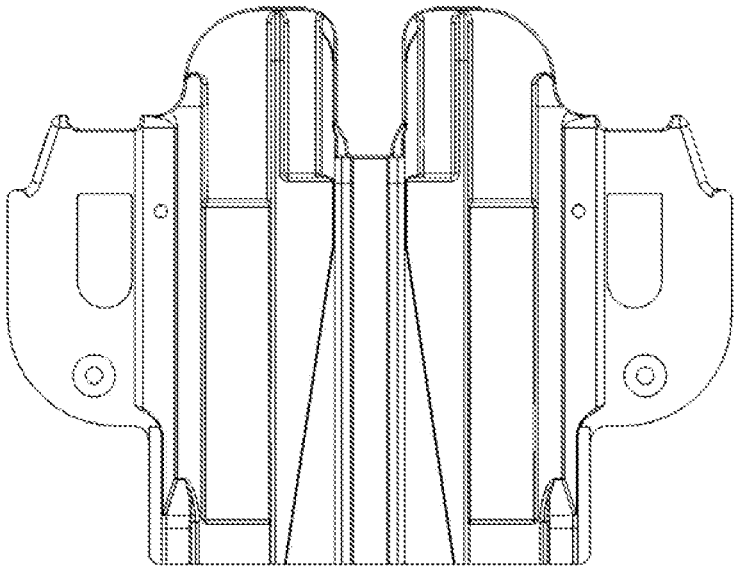
FIG. 32 is a plan view of an embodiment of a flat plastic body of the holster with spacer in a flat position.
Figure 33:
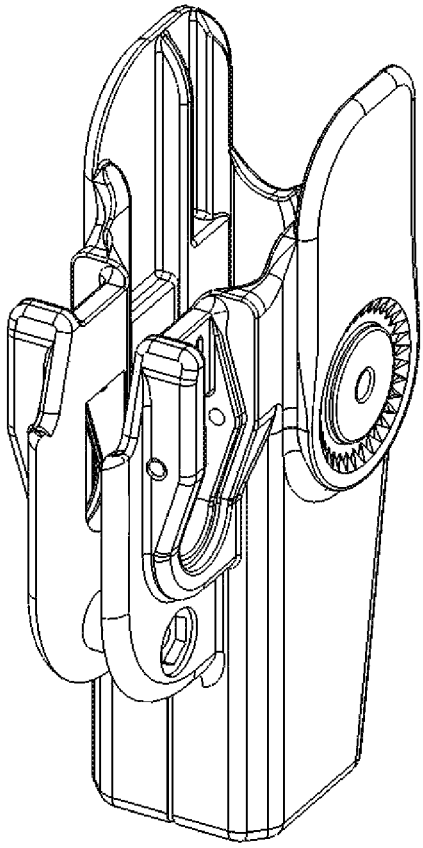
FIG. 33 is a perspective view of an embodiment of a body of the holster in a folded position.
Figure 34:
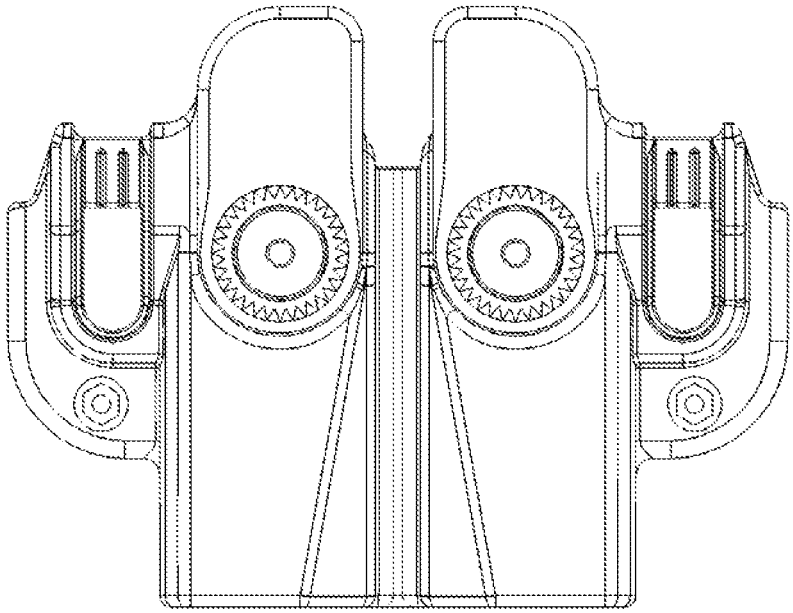
FIG. 34 is a plan view of an embodiment of a body of the holster in a flat position.
Figure 35:
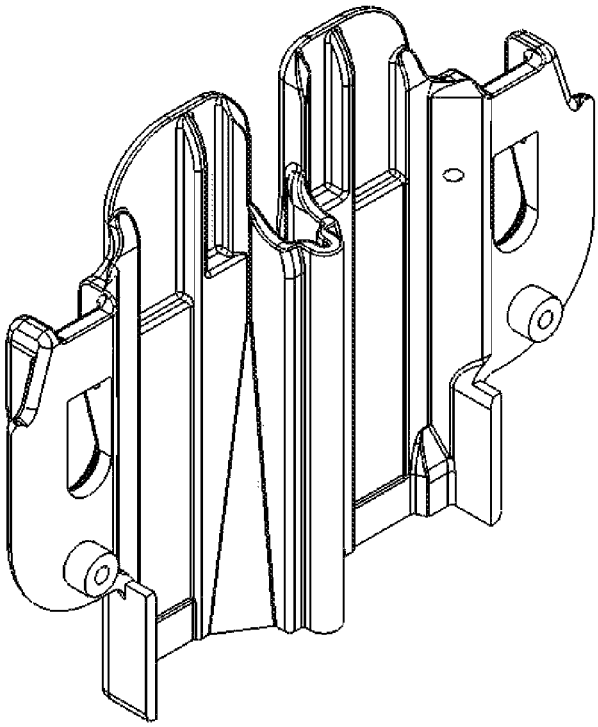
FIG. 35 is a perspective view of an embodiment of a body of the holster in a flat position.
Figure 36:
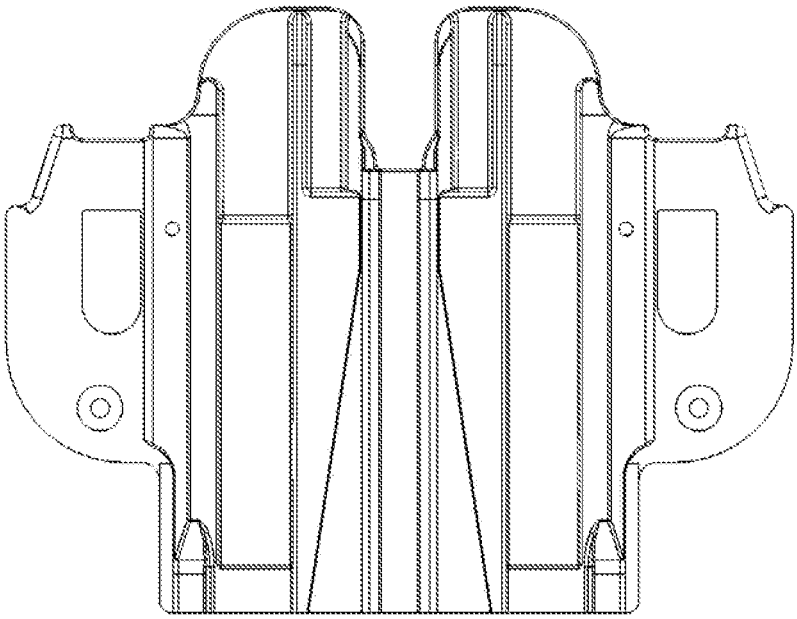
FIG. 36 is a plan view of an embodiment of a body of the holster in a flat position.
Figure 37:
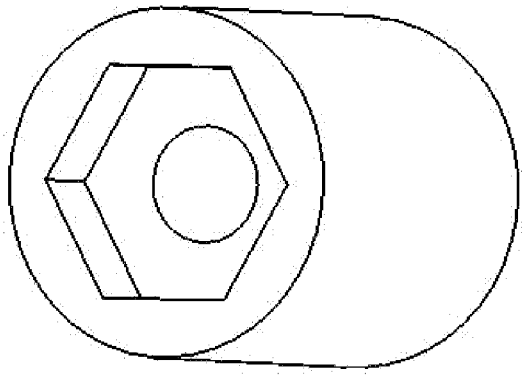
FIG. 37 is a perspective view of an example of the spacer.
Figure 38:
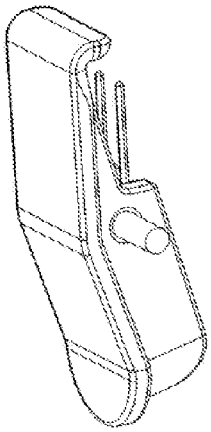
FIG. 38 is a lateral view of another embodiment of a resistance safety catch.
Figure 39:
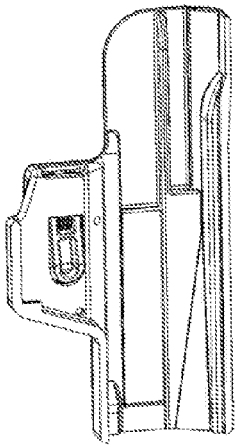
FIG. 39 is a view of the inside of the holster with the resistance safety catch as in FIG. 38.
Figure 40:
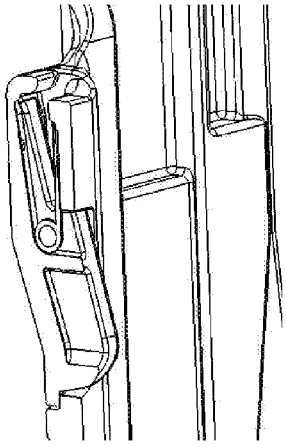
FIG. 40 is a vertical section of the body of the holster with the resistance safety catch.
Figure 41:
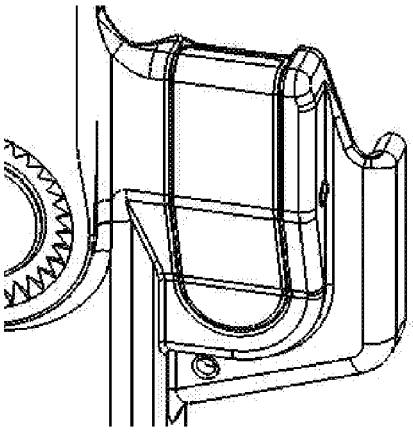
FIG. 41 is a view from the outer side of the resistance safety catch in the body of the holster.
Figure 42:
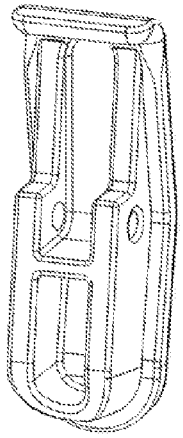
FIG. 42 is a perspective view of the inner side of the resistance safety catch FIG. 38.
Figure 43:
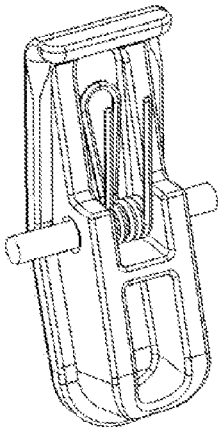
FIG. 43 is the view of FIG. 42, with a mounted pin and inner spring.

FIG. 18 shows an embodiment of a twin-torsional distancing spring which serves to press the functional part of the thumb and index-finger safety catches into the inner space of the holster cavity in the area of the trigger guard of the gun. For the sake of clarity, FIGS. 19 to 21 show in dismantled state the assemblies of holster body and relevant safety catches, in FIG. 19 with index-finger safety catch, in FIG. 20 with thumb safety catch and in FIG. 21 with resistance safety catch. FIG. 22 shows an assembly of holster body with mounted safety catches, on one side with thumb safety catch and on the opposite side with resistance safety catch. FIG. 23 shows a similar assembly with resistance safety catches along both sides of the body of the holster. FIG. 24 shows an assembly according to FIG. 22, with the additional security of a covering flap, in FIG. 25 with the additional security of a restraining strap. FIG. 26 shows the assembly according to FIG. 23 with the additional security of a covering flap, FIG. 27 with the addition of a restraining strap. FIGS. 28 to 31 show various embodiments of the holster support, with body rests for the support in FIGS. 28 and 31. FIGS. 32 to 36 show several embodiments and various views of the flat plastic body of the holster with spacer, where the lateral sides of that body are bent into a U-shape to form the subsequent through cavity and secured in the desired position, for example by a screw and nut. FIG. 37 shows an example of the spacer. FIGS. 38 to 43 show examples of a further embodiment of the resistance safety catch which has an inner spring with the same function as a thumb and index-finger safety catch and which uses the same pins and springs. Its lower part is rounded for the taper of the trigger guard of the gun and full deflection of the safety catch during withdrawal of the gun from the holster. FIG. 38 shows a lateral view of this resistance safety catch with inner spring and pin; FIG. 39 is a view in the direction of the inside of the holster with the positioning of the resistance safety catch as in FIG. 38. FIG. 40 shows a vertical section of the body of the holster with the resistance safety catch, and FIG. 41 is a view from the outer side of the resistance safety catch in the body of the holster. The resistance safety catch is shown from the inner side in FIG. 42, and also from the inner side in FIG. 43, with mounted pin and inner spring.

Referring again to FIG. 1, the handgun holster comprises a shaped self-supporting body 1 made of plastic with through cavity for inserting and withdrawing the gun, which is furnished with a support 16 for attaching the holster to the user (the support 16 can also be furnished with a body rest 17) and also with a safety catch 7 and a security system against removal of the gun from the holster (restraining strap 6 or covering flap 19). In the rear wall of the body 1 of the holster, there is an upwardly open slot to facilitate the insertion and withdrawal of the gun.

In each of the two side walls 2 of the holster body 1, in the area designed for ensuring the position of the inserted gun, there is a specularly arranged recess 20 in which a trigger safety catch 7 is lodged. The side walls 2 of the body 1 of the holster are specularly arranged and are reinforced in the area of the recess 20. This recess 20 has an opening 21 for passage of the functional part 11 of the safety catch 7 into the cavity of the holster in the area designed for positioning the trigger guard of the gun. The outer covering of the safety catch 7, in the resting position, fits against the outer peripheral surface of the recess 20. The functional part 11 of the safety catch 7 is a flat projection 22 whose outer perimeter is smaller than the outer perimeter of the covering of the safety catch 7, so that this covering bears against the shoulder formed along the inner perimeter of the recess 20. Each safety catch 7 is positioned on a pin 8 fastened into the corresponding side wall 2 of the body 1 of the holster.

The safety catch 7 in one of the embodiments is a twin-arm lever and is pushed by its functional part 11, under pressure from a distancing spring 9 positioned in a shaped recess of the functional part 11 on a pin 8 (which forms the rotational axis of the safety catch 7), into the through cavity of the body 1 of the holster and at the same time it is furnished with a stop 12 of the opening motion of the safety catch 7. The control part 10 of the safety catch 7 can project from the body 1 of the holster. This involves the so-called thumb safety catch (FIGS. 5 and 6). In another embodiment, the whole outer surface of the safety catch 7 fits against the outer surface of the side wall 2 of the body 1 of the holster. This involves the so-called index-finger safety catch (FIGS. 7 and 8). The functional part 11 of the safety catch 7, in the secured functional position, is pressured by a spring 9 into the inner through cavity of the holster in the area of the trigger guard, where it rests in this position against the shoulder formed along the inner perimeter of the recess 20. In the secured functional position against the pressure of the spring 9, in which the functional part 11 of the lever fits against the surface of the through cavity of the holster, the safety catch 7 rests against the stop 12 at the bottom of the recess 20.

The control part 10 of the lever of the thumb safety catch 7 is user comfortable, has an ergonomic shape with an axially deflected and widened blade facilitating control in all modes of year-round use of the holster. The shape of the control part 10 of the lever of the safety catch 7 also permits use of this safety element as a dual safety catch, that is using the thumb and index-finger at the same time and in all modes of use of the holster. It is also possible to use each of them independently without limiting the performance of any of the parts used. An advantage of this additional safety and also security element lies in the ease of assembly and serviceability for the required security arrangement. It is advantageous that the safety catch 7 is a unified assembly part for the thumb and index-finger embodiments. This two-stage security arrangement is simple and safe, release of the two safety catches 7 (positioned along the two lateral walls 2 of the body 1 of the holster) occurs at the same time, essentially automatically, on grasping the gun in the holster with the thumb and index-finger of the appropriate left or right controlling hand, or successively in whichever order is chosen. The index-finger safety catch does not protrude at all from the holster, thus limiting the chances of some equipment or other outer object getting caught on the safety catch from outside the holster.

The security mechanism in all these active security elements is the same. In inserting the gun into the holster, the trigger guard overcomes the resistance of the deflected functional part 11 of the safety catch 7. Securing of the gun occurs automatically after complete insertion of the gun as far as the inner stop of the holster. The security element in the case of the index-finger safety catch 7 is controlled by the index-finger of the relevant controlling hand of the user, by squeezing the upper contact surface of the controlling part 10 of the safety catch 7. By pressing the contact surface under the level of the side wall 2 of the holster, the functional part 11 of the lever is deflected, whereby actual release of the safety mechanism occurs. The gun is released and ready to be withdrawn from the holster. After withdrawal of the gun, return deflection of the functional part 11 of the lever of the security element into the cavity of the holster occurs automatically. The mechanism is thus ready for repeat securing of the gun during insertion into the holster.

In another embodiment, the functional part (11) of the safety catch (7) is a rounded flexible tongue (3) shaped so that it extends, with its free flexible end (4), into the through cavity of the body (1) of the holster in the area of the trigger guard of the gun, whilst its upper end with the stop 12 rests against the bottom of the recess 20 in the side wall 2 of the holster (FIGS. 9 and 10). This so called resistance safety catch, like the index-finger safety catch, fits with the whole of its outer surface against the outer surface of the side wall 2 of the body of the holster. During insertion and securing of the gun in the holster, the flexible tongue 3 is pushed by the trigger guard of the gun to the side wall 2 of the body 1 of the holster, and when the gun is inserted as far as the inner stop of the holster, the tongue 3, again thanks to its flexibility, returns to its initial position in the cavity of the holster and secures the gun in position. After its complete insertion as far as the inner stop of the holster, the gun is secured automatically by the return springing movement of the protruding, flexible shaped surface of the tongue 3 into the free space above the frame of the trigger guard.

The resistance safety catch 7, which can also contain an inner spring 9, basically works like a thumb and index-finger safety catch and uses the same pins and springs (FIGS. 38 to 43). The shape is the same as in all the safety catches, except that in the lower part the safety catch is rounded for the taper of the trigger guard and full deflection of the safety catch during withdrawal of the gun from the holster. This element can be mounted in pairs or in combination with all current types of safety catches. The basic difference between the resistance safety catch 7 with inner spring 9 and the index-finger safety catch (see FIGS. 7 and 8) lies in the possibility of releasing and withdrawing the gun from the holster, simply by overcoming the resistance of the inner spring 9 without the need for any action, that is without releasing the safety catch with the index-finger of the relevant control hand. A further difference between the resistance safety catch 7 with inner spring 9 and the resistance safety catch according to FIGS. 9 and 10 lies in the possibility of setting the resistance of the securing elements by replacing the inner spring 9 with a stronger or weaker one, according to the requirement of the user. The user of the holster is thus able to regulate the resistance of the safety catch during withdrawal of the gun from the holster, and can adjust the resistance of safety catches by using springs of various strengths or shapes. Use of springs has the advantage of increasing the life-span by comparison with plastics which suffer from material fatigue, and is advantageous from the point of view of long-term durability and frequent use of the security element.

The side walls 2 of the body 1 of the holster are furnished on their outer surface with a circular recess 14 with cogged perimeter 15 and a central threaded opening 18 for adjustable fastening of the support 16 of the holster, or of the end of the restraining strap 6 or the release lever 5 of the restraining strap 6, or of the covering flap 19. The support 16 is furnished, on its bearing surface, with molded teeth which mesh with the complementary teeth in the side wall 2 of the body 1 of the holster. The actual arrest is accomplished by their screw-like connection.

There can be various embodiments of the support 16, generally serving to fasten and carry the holster on the user's belt. The fastening system facilitates the setting of the angle of the holster according to the requirements of the user and the use of the support in right-handed or left-handed assemblies. The width of the belt can be set by means of an adjustable catch.

The body 1 of the holster is further provided with a security system against withdrawal of the gun from the holster, which is a plastic, flexible, flat restraining strap 6 to go around the gun and a plastic release lever 5 for that strap 6, mutually connected at the control point by a latching connection, by a snap rivet for example. The user of the gun unfastens the restraining strap 6 and the release lever 5 by deflecting the release lever 5 to the side, in the direction away from the body 1 of the holster, towards the support 16 for attaching the holster to the user. The snap rivet is thereby unfastened and the restraining strap 6 is released. Security against withdrawal of the gun is assured by the opposite procedure, by fastening the snap rivet with the pressure of the release lever 5 against the other part of the clasp on the restraining strap 6. The release lever 5 is the controlling element of the security system described here.

A further system element for additional safeguarding of the gun is the covering flap 19, which is used for additional protection of the gun in the face of heightened possibility of damage, of appropriation of the gun by a stranger, or for long-term covering of the gun against adverse meteorological conditions. Attachment of the covering flap 19 is again effected by means of a screwed connection with anchorage in the side wall 2 of the holster in the position of the cogged segment (circular recess 14 with cogged perimeter 15 and central threaded opening 18), between the body of the holster and the belt support.

The kit of uniform parts for the holster permits a high degree of variability depending upon the intended use and requirements of the user. It is possible, quite simply and without the need for modification and further parts, to arrange a right-hand holster on the left, and vice-versa. This is economically advantageous, particularly in armed units where individual membership is constantly changing and therefore also the ratio of right- to left-handed members. A further economic advantage is the basic simplification of logistical security, as it is not necessary to stock and keep separate records of supply items for right and left-handed members. The multi-functional holster, with support 16, safety catch 7 and restraining strap 6, permits not only user modification of the holster from right to left side and vice-versa, but also easy dismantling of the safety catch 7 or restraining strap 6, so that it is possible to select only one of these security systems. That may be preferable for members of special units where one security system is sufficient and speed of use is favoured over multiple safety measures. A further possible modification in the function of the holster is the replacement of the thumb safety catch 7 by an index-finger or resistance safety catch 7. That modification can be carried out easily and quickly by simply transferring the thumb safety catch 7 (including its spring 9 and pin 8) to the opposite side wall 2 of the holster.

The front wall of the body 1 of the holster has a guide groove 13 for the gun sights, on the inside and running from top to bottom of said front wall. The integrated guides so formed for the sights guide and demarcate the position of the gun in the holster during insertion and withdrawal, and protect the sights against damage during manipulation of the gun in the holster. The shape of the guide for the sights, with the protruding side walls of the guide groove 13 running from top to bottom of the holster, together with the bend in the mould of the body 1 of the holster, in the grooves located on the inner side of the mould of the body 1 of the holster along both sides of the guide for the gun sights, increases the rigidity of the holster.

The body 1 of the holster can be a flat plastic part with spacer (see FIGS. 32 to 37), the lateral sides of which are then bent into a U-shape, so that the spacer (FIG. 37) defines the closed or partly open through cavity for inserting the gun into the holster. The spacer can be made of plastic, rubber or metal and determines the shape and dimensions of the inside cavity of the holster according to the shape of the gun and at the same time it acts as a braking and spacing element to ensure the comfort of the user according to his/her specific requirements on putting the gun into the holster.

The holster is designed for a handgun and allows for simple adjustment, without the need for modification and further parts, from a right-hand to a left-hand holster and vice-versa, according to the intended use and requirements of the user. It also allows the user to choose one or more safeguards for the gun in the holster, again according to the specific intended use of the gun.

Having described a few example embodiments, it should be apparent to those skilled in the art that the foregoing is merely illustrative and not limiting, having been presented by way of example only. Numerous modifications and other embodiments are with the scope of ordinary skill in the art and are contemplated as falling with the scope of the invention.

What is claimed is:

1. A handgun holster kit, comprising:

a holster body including two side walls defining a through cavity for inserting and withdrawing a gun, each wall having an inner surface facing the gun and an outer surface;

a plurality of safety catches, including a thumb catch, an index finger catch and at least two resistance catches;

a plurality of pins, each pin adapted to fit each of the safety catches;

a plurality of springs, each spring adapted to fit at least the thumb catch and the index finger catch; and wherein, in the outer surface of each of the two side walls of the holster body, in an area of the through cavity designed for the gun, there are specularly arranged recesses, with one recess in each of the two side walls in which one of the safety catches is adapted to be attached, each of the safety catches being adapted to fit in each of the recesses, wherein each recess has an opening for passage of a functional part of each of the safety catches into the through cavity in an area designed for positioning a trigger guard of the gun, wherein an outer covering of each safety catch, when in a resting position on the holster, is flush with an outer peripheral surface of the recess, wherein the functional part of each safety catch is a projection having an outer perimeter smaller than an outer perimeter of the outer covering of the safety catch, so that an inner surface of the outer covering bears against a shoulder formed along an inner perimeter of the recess when the safety catch is mounted in the recess and in the resting position, wherein each safety catch is adapted to be mounted in each of the recesses with one of the pins, such that the safety catch can rotate about the pin when mounted, wherein the thumb catch and index finger catch are adapted to be mounted in each recess with one of the springs, wherein the spring is adapted to be positioned between an inner surface of the safety catch and the outer surface of the recess so that, when the safety catch is mounted in the recess with the spring, the spring pushes the functional part of the safety catch through the opening and into the through cavity of the holster body, and wherein each resistance catch is adapted to be mounted in each of the recesses.

2. A handgun holster kit according to claim 1, wherein at least one of the safety catches is a twin-arm lever and the spring is positioned on a pin, wherein the twin-arm lever is pushed by its functional part, under pressure from the spring, into the through cavity of the body of the holster and is furnished with a stop for opening motion of the safety catch.

3. A handgun holster kit according to claim 2, wherein a control part of the at least one of the safety catches projects from the body of the holster.

4. A handgun holster kit according to claim 2, wherein an outer surface of each safety catch fits against an outer surface of the side wall of the body of the holster.

5. A handgun holster kit according to claim 4, wherein a lower part of the functional part of the resistance catch, in the direction of the through cavity of the body of the holster, is rounded for a taper of the trigger guard of the gun and full deflection of the safety catch during withdrawal of the gun from the holster.

6. A handgun holster kit according to claim 1, wherein the functional part of the resistance catch is a rounded flexible tongue having a free flexible end shaped to extend into the through cavity of the body of the holster, and a stop is embedded in the side wall of the body of the holster to engage an upper end of the safety catch.

7. A handgun holster kit according to claim 6, wherein the side walls of the body of the holster are specularly arranged and are reinforced in the area of the recess.

8. A handgun holster kit according to claim 7, wherein the side walls of the body of the holster are furnished on their outer surface with a circular recess with cogged perimeter and with a central threaded opening for adjustable fastening of a support of the holster in a chosen position.

9. A handgun holster kit according to claim 8, wherein a front wall of the body of the holster has a guide groove for gun sights, on an inside surface of the through cavity from top to bottom of the front wall.

10. A handgun holster kit according to claim 9, wherein, in a rear wall of the body of the holster, there is an upwardly open slot to facilitate insertion and withdrawal of the gun.

11. A handgun holster kit according to claim 10, wherein the support is furnished with a body rest.

12. A handgun holster kit according to claim 11, wherein the body of the holster is a flat plastic molded part with lateral sides bent into a U-shape to form the through cavity.

13. A handgun holster kit, comprising:

a holster body including two side walls defining a through cavity for inserting and withdrawing a gun, each wall having an inner surface facing the gun and an outer surface;

a plurality of safety catches, including a thumb catch, and index finger catch and at least two resistance catches, wherein the thumb catch and the index finger catch have a functional part with a flat projection, and wherein the resistance catches have a functional part with a rounded projection;

a plurality of pins, each pin adapted to fit each of the safety catches;

a plurality of springs, each spring adapted to fit at least the thumb catch and the index finger catch;

wherein the outer surface of each of the two side walls of the holster body, in an area of the through cavity designed for the gun, includes specularly arranged recesses, with one recess in each of the two side walls in which one of the safety catches is adapted to be attached, each of the safety catches being adapted to fit in each of the recesses;

wherein each recess has an opening for passage of the functional part of each of the safety catches into the through cavity in an area designed for positioning a trigger guard of the gun;

wherein each safety catch is adapted to be mounted in each of the recesses with one of the pins, such that the safety catch can rotate about the pin when mounted;

wherein the thumb catch and index finger catch are adapted to be mounted in one of the recesses with one of the springs, wherein the spring is positioned between an inner surface of the safety catch and the outer surface of the recess so that, when the safety catch is mounted in the recess with the spring, the spring pushes the functional part of the safety catch through the opening and into the through cavity of the holster body, and wherein each resistance catch is adapted to be mounted in each of the recesses.

14. A handgun holster kit according to claim 13, wherein the recess has an outer peripheral surface and a shoulder formed along an inner perimeter of the recess, wherein each safety catch has an outer covering that is flush with the outer peripheral surface of the recess when the safety catch is in a resting position, and wherein the functional part of the safety catch is a projection having an outer perimeter smaller than an outer perimeter of the outer covering of the safety catch, so that an inner surface of the outer covering of the safety catch bears against the shoulder of the recess when the safety catch is in the resting position.

15. A handgun holster kit according to claim 13, wherein each of the side walls of the body of the holster is furnished on the outer surface with a circular recess with a cogged perimeter and a central threaded opening for adjustable fastening of a support of the holster in a chosen position.

* * * * *